US007923594B2

(12) United States Patent
Hommeltoft

(10) Patent No.: US 7,923,594 B2
(45) Date of Patent: Apr. 12, 2011

(54) PROCESS FOR PRODUCING MIDDLE DISTILLATE BY ALKYLATING C5+ ISOPARAFFIN AND C5+ OLEFIN

(75) Inventor: Sven Ivar Hommeltoft, Pleasant Hill, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 443 days.

(21) Appl. No.: 12/184,156

(22) Filed: Jul. 31, 2008

(65) Prior Publication Data

US 2010/0025296 A1 Feb. 4, 2010

(51) Int. Cl.
*C07C 2/60* (2006.01)
*C07C 2/62* (2006.01)

(52) U.S. Cl. ..... 585/724; 585/725; 585/727; 585/728

(58) Field of Classification Search ..... 585/724, 585/725, 727, 728
See application file for complete search history.

(56) References Cited

U.S. PATENT DOCUMENTS

| | | | |
|---|---|---|---|
| 674,962 | A | 5/1901 | Cuming |
| 4,423,277 | A | 12/1983 | Stroud |
| 4,501,653 | A | 2/1985 | Hamner et al. |
| 5,877,383 | A | 3/1999 | Hommeltoft et al. |
| 5,994,601 | A | 11/1999 | Nierlich |
| 6,121,396 | A | 9/2000 | Sone et al. |
| 6,605,206 | B1 | 8/2003 | Johnson |
| 6,768,035 | B2 | 7/2004 | O'Rear et al. |
| 6,841,711 | B2 | 1/2005 | Krug et al. |
| 6,890,423 | B2 | 5/2005 | O'Rear |
| 7,320,748 | B2 | 1/2008 | Hemighaus et al. |
| 2004/0267070 | A1 | 12/2004 | Johnson et al. |
| 2005/0245778 | A1 | 11/2005 | Johnson et al. |
| 2006/0100473 | A1 | 5/2006 | Grootjans et al. |
| 2006/0131209 | A1 | 6/2006 | Timken et al. |
| 2006/0237344 | A1 | 10/2006 | Abernathy et al. |
| 2007/0142684 | A1 | 6/2007 | Elomari et al. |
| 2007/0142690 | A1 * | 6/2007 | Elomari ..... 585/727 |
| 2007/0225538 | A1 | 9/2007 | Elomari |

FOREIGN PATENT DOCUMENTS

| | | |
|---|---|---|
| EP | 0839781 B1 | 10/2001 |
| JP | 2002020326 | 1/2002 |

OTHER PUBLICATIONS

Sven Ivar Hommeltoft, "Flexibility of a New Fixed-Bed Alkylation Technology Applying a Supported Liquid Superacid in a Movable Catayst Zone", Symposium on New Chemistry with Solid-Acid Catalysts in the Alkylation of Isobutane with Olefins. Aug. 25-29, 1996, pp. 600-705.

U.S. Appl. No. 12/003,576, Ionic Liquid Catalyst Alkylation Using a Loop Reactor (Isoparaffin Recirculation),Huping Luo et al., Filed Dec. 25, 2007. 15 pages.

U.S. Appl. 12/003,580, Ionic Liquid Catalyst Alkylation Using Split Reactants Stream, Huping Luo et al., Filed Dec. 28, 2007, 16 pages.

* cited by examiner

*Primary Examiner* — Thuan Dinh Dang
(74) *Attorney, Agent, or Firm* — Susan M. Abernathy

(57) ABSTRACT

An alkylation process, comprising providing an isoparaffin feed that comprises at least 20 wt % C5+, providing a hydrocarbon stream that comprises at least 20 wt % C5+ olefins, and contacting the isoparaffin feed and the hydrocarbon stream with an ionic liquid catalyst under alkylation conditions wherein a middle distillate is produced. The middle distillate has less than 10 ppm sulfur and less than 3 wt % olefin. An alkylation process comprising contacting a naphtha with a low RON and a hydrocarbon stream comprising C5 olefins to an ionic liquid alkylation reactor under alkylation conditions, and recovering a middle distillate comprising less than 3 wt % olefin. A refinery process, comprising a hydrocracker that produces C5+ isoparaffin, a FC cracker that produces a hydrocarbon stream comprising a C5+ olefin, and an ionic liquid alkylation reactor that produces a high yield of middle distillate.

29 Claims, No Drawings

PROCESS FOR PRODUCING MIDDLE DISTILLATE BY ALKYLATING C5+ ISOPARAFFIN AND C5+ OLEFIN

This application is related to four co-filed patent applications titled "Process for Producing a Middle Distillate", "Process for Producing a Low Volatility Gasoline Blending Component and a Middle Distillate", "Process for Producing a Jet Fuel", and "Composition of Middle Distillate", herein incorporated in their entirety.

FIELD OF THE INVENTION

This invention is directed to alkylation and refinery processes for producing middle distillate.

DETAILED DESCRIPTION OF THE INVENTION

Definitions:

The term "comprising" means including the elements or steps that are identified following that term, but any such elements or steps are not exhaustive, and an embodiment may include other elements or steps.

A "middle distillate" is a hydrocarbon product having a boiling range between 250° F. and 1100° F. (121° C. and 593° C.). The term "middle distillate" includes the diesel, heating oil, jet fuel, and kerosene boiling range fractions. It may also include a portion of naphtha or light oil. A "naphtha" is a lighter hydrocarbon product having a boiling range between 100° F. and 400° F. (38° C. to 204° C.).

The "boiling range" is the 10 vol % boiling point to the final boiling point (99.5 vol %), inclusive of the end points, as measured by ASTM D 2887-06a and ASTM D 6352-04. A hydrocarbon product having a boiling range of 150° C.+ is one that has a 10 vol % boiling point of 150° C. or higher.

"Alkyl" means a linear saturated monovalent hydrocarbon radical of one to twelve carbon atoms or a branched saturated monovalent hydrocarbon radical of three to twelve carbon atoms. In one embodiment, the alkyl groups are methyl. Examples of alkyl groups include, but are not limited to, groups such as methyl, ethyl, n-propyl, isopropyl, n-butyl, isobutyl, sec-butyl, t-butyl, n-pentyl, and the like.

"Unsupported" means that the catalyst or the halide containing additive is not on a fixed or moveable bed of solid contact material, such as non-basic refractory material, e.g., silica.

Test Method Descriptions:

The test methods used for boiling range distributions of the compositions in this disclosure are ASTM D 2887-06a and ASTM D 6352-04. The boiling range distribution determination by distillation is simulated by the use of gas chromatography. The boiling range distributions obtained by this test method are essentially equivalent to those obtained by true boiling point (TBP) distillation (see ASTM Test Method D 2892), but are not equivalent to results from low efficiency distillations such as those obtained with ASTM Test Methods D 86 or D 1160.

Reid Vapor Pressure (RVP) is measured directly by ASTM D 5191-07. Alternatively, RVP is calculated from the boiling range data obtained by gas chromatography. The calculation is described in the ASTM special publication by de Bruine, W., and Ellison, R. J., "Calculation of ASTM Method D 86-67 Distillation and Reid Vapor Pressure of a Gasoline from the Gas-Liquid Chromatographic True Boiling Point," STP35519S, January 1975.

Sulfur is measured by ultraviolet fluorescence by ASTM 5453-08a.

Diene is measured by high resolution gas chromatography, for example as described in ASTM D 6733-01 (R-2006).

The Research-Method Octane Number (RON) is determined using ASTM D 2699-07a.

The wt % of the C5+ olefins is determined by high resolution gas chromatography (GC), such as by ASTM D 6733-01 (R-2006). The wt % of the C5+ in the hydrocarbon stream is also determined by high resolution gas chromatography.

The yield of middle distillate based on the amount of olefin reacted is calculated by determining the weight yield of material boiling above 150° C. using GC analysis on the combined product mixture, and relating this weight yield of middle distillate to the total weight amount of olefins in the feed mixture as determined by GC analysis—i.e. weight middle distillate in product/weight olefin in feed. In the specific experiments, since the product was not fractionated, the middle distillate and olefin concentrations (in wt %) in product and feed respectively were used to determine the selectivity directly:

Yield of middle distillate relative to olefin converted= (wt % material boiling above 150° C. in product mixture)/(wt % olefins in feed mixture).

The method for determining the wt % olefins is described in US Patent Publication No. US20060237344, fully incorporated herein. The method for determining the wt % olefins is by $^1$H NMR. The wt % olefins by $^1$H NMR is determined by the following steps, A-D:

A. Prepare a solution of 5-10% of the test hydrocarbon in deuterochloroform.
B. Acquire a normal proton spectrum of at least 12 ppm spectral width and accurately reference the chemical shift (ppm) to tetramethylsilane (TMS). When a 30° pulse is applied, the instrument must have a minimum signal digitization dynamic range of 65,000. Preferably the dynamic range will be 260,000 or more.
C. Measure the integral intensities between:
   6.0-4.5 ppm (olefin)
   2.2-1.9 ppm (allylic)
   1.9-0.5 ppm (saturate)
D. Using the molecular weight of the test substance % olefin in the sample was calculated.

The weight percent of olefins by $^1$H NMR calculation procedure works best when the percent olefins result is low, less than about 15 wt %.

Alkylation Processes

In a first embodiment, there is provided an alkylation process comprising: a) providing an isoparaffin feed that comprises at least 20 wt % C5+; b) providing a hydrocarbon stream that comprises at least 20 wt % C5+ olefins; and contacting the isoparaffin feed and the hydrocarbon stream with an ionic liquid catalyst in an alkylation zone under alkylation conditions wherein a middle distillate is produced. In this embodiment the middle distillate has less than 10 ppm sulfur, and less than 3 wt % olefin, prior to any optional hydrofinishing.

In a second embodiment there is provided an alkylation process comprising contacting a naphtha having a RON less than 70 and a hydrocarbon stream comprising C5 olefins in an ionic liquid alkylation reactor under alkylation conditions to produce an alkylate product, and recovering a middle distillate from the alkylate product, wherein the middle distillate comprises less than 3 wt % olefin prior to any optional hydrofinishing.

There is also provided a refinery process, comprising a hydrocracker that produces a C5+ isoparaffin, a FC cracker that produces a hydrocarbon stream comprising an olefin, and an ionic liquid alkylation reactor. The alkylation reactor alkylates the C5+ isoparaffin and the hydrocarbon stream to produce a middle distillate. The yield of the middle distillate is at least 1.3 times, on a weight basis, the amount of the olefin reacted in the ionic liquid alkylation reactor.

In some embodiments the isoparaffin feed comprises at least 20 wt % C5+. For example, it can comprise at least 40 wt %, at least 50 wt %, at least 60 wt %, at least 70 wt %, at least 80 wt %, or at least 90 wt %.

In some embodiments the hydrocarbon stream comprises at least 20 wt % C5+ olefins. For example, it can comprise at least 40 wt %, at least 50 wt %, at least 60 wt %, at least 70 wt %, at least 80 wt %, or at least 90 wt %. The hydrocarbon stream can comprise a naphtha. The naphtha can come from any well known processes, such as from a hydrocracking operation or a Fischer-Tropsch process.

In some embodiments the hydrocarbon stream is from a hydrocracking operation. For example, the hydrocarbon stream can comprise FC cracker pentene. In some embodiments the hydrocarbon stream has a relatively high sulfur content, such as greater than 100 ppm, greater than 200, greater than 500 ppm, or greater than 1,000 ppm. In some embodiments the hydrocarbon stream has a low diene content, such as less than 1,000 ppm, less than 500 ppm, less than 200 ppm, or less than 100 ppm.

In some embodiments the naphtha has a relatively low RON, such as less than 80, less than 70, less than 60, or less than 50. These naphthas are less desired, and it is a benefit when they are upgraded into higher value products.

In some embodiments the naphtha has a relatively high vapor pressure. For example it can have a RVP greater than 20.7 kPa (3 psi) greater than 24.2 kPa (3.5 psi), greater than 34.5 kPa (5 psi), or greater than 48.3 kPa (7 psi). It is desired to upgrade these lower quality naphthas into higher value products.

In some embodiments the hydrocarbon stream has a high vapor pressure. For example it can have a RVP greater than 20.7 kPa (3 psi) greater than 24.2 kPa (3.5 psi), greater than 34.5 kPa (5 psi), greater than 44.8 kPa (6.5 psi), or greater than 48.3 kPa (7 psi). It is desired to upgrade these high volatility hydrocarbon streams into higher value products.

The middle distillate has a low sulfur content, generally less than 100 ppm or 50 ppm, but it can be less than 10 ppm, less than 5 ppm, less than 1 ppm, or essentially zero. The middle distillate has a low olefin content, which provides it with excellent oxidation stability. The olefin content is generally less than 15 wt %, but it can be less than 5 wt %, less than 3 wt %, less than 2 wt %, less than 1 wt %, less than 0.5 wt %, or less than 0.1 wt %. In some embodiments, the low sulfur and olefin contents are achieved without any hydrofinishing after the alkylation in the ionic liquid alkylation reactor or alkylation zone. In other embodiments a mild hydrofinishing after the alkylation step may be utilized to provide further improved sulfur and olefin levels in the middle distillate.

Hydrofinishing operations are intended to improve the oxidation stability and color of the products. A general description of the hydrofinishing process may be found in U.S. Pat. Nos. 3,852,207 and 4,673,487. Temperature ranges in a hydrofinishing reactor are usually in the range of from about 300° F. (150° C.) to about 700° F. (370° C.), with temperatures of from about 400° F. (205° C.) to about 500° F. (260° C.) being preferred. The LHSV is usually within the range of from about 0.2 to about 2.0, preferably 0.2 to 1.5 and most preferably from about 0.7 to 1.0. Hydrogen is usually supplied to the hydrofinishing reactor at a rate of from about 1,000 to about 10,000 SCF per barrel of feed. Typically the hydrogen is fed at a rate of about 3,000 SCF per barrel of feed.

Ionic Liquid Catalyst

The ionic liquid alkylation zone, or reactor, comprises an ionic liquid catalyst. The ionic liquid catalyst is composed of at least two components which form a complex. To be effective at alkylation the ionic liquid catalyst is acidic. The acidic ionic liquid catalyst comprises a first component and a second component. The first component of the catalyst will typically comprise a Lewis Acidic compound selected from components such as Lewis Acidic compounds of Group 13 metals, including aluminum halides, alkyl aluminum halide, gallium halide, and alkyl gallium halide (see International Union of Pure and Applied Chemistry (IUPAC), version 3, October 2005, for Group 13 metals of the periodic table). Other Lewis Acidic compounds besides those of Group 13 metals may also be used. In one embodiment the first component is aluminum halide or alkyl aluminum halide. For example, aluminum trichloride may be used as the first component for preparing the ionic liquid catalyst.

The second component making up the ionic liquid catalyst is an organic salt or mixture of salts. These salts may be characterized by the general formula Q+A−, wherein Q+ is an ammonium, phosphonium, boronium, iodonium, or sulfonium cation and A− is a negatively charged ion such as Cl−, Br−, $ClO_4^-$, $NO_3^-$, $BF_4^-$, $BCl_4^-$, $PF_6^-$, $SbF_6^-$, $AlCl_4^-$, $ArF_6^-$, $TaF_6^-$, $CuCl_2^-$, $FeCl_3^-$, $SO_3CF_3^-$, $SO_3C_7^-$, and 3-sulfurtrioxyphenyl. In one embodiment the second component is selected from those having quaternary ammonium halides containing one or more alkyl moieties having from about 1 to about 9 carbon atoms, such as, for example, trimethylamine hydrochloride, methyltributylammonium, 1-butylpyridinium, or hydrocarbyl substituted imidazolium halides, such as for example, 1-ethyl-3-methyl-imidazolium chloride. In one embodiment the ionic liquid catalyst is an acidic haloaluminate ionic liquid, such as an alkyl substituted pyridinium chloroaluminate or an alkyl substituted imidazolium chloroaluminate of the general formulas A and B, respectively.

A

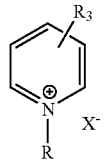

B

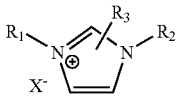

In the formulas A and B; R, $R_1$, $R_2$, and $R_3$ are H, methyl, ethyl, propyl, butyl, pentyl or hexyl group, X is a chloroaluminate. In the formulas A and B, R, $R_1$, $R_2$, and $R_3$ may or may not be the same. In this embodiment the method also comprises separating out the middle distillate from the alkylate product, wherein the separated middle distillate fraction is from 20 wt % or higher of the total alkylate product.

In another embodiment the acidic ionic liquid catalyst has the general formula RR' R" N $H^+$ $Al_2Cl_7^-$, and wherein RR' and R" are alkyl groups containing 1 to 12 carbons, and where RR' and R" may or may not be the same.

The presence of the first component should give the ionic liquid a Lewis or Franklin acidic character. Generally, the greater the mole ratio of the first component to the second component, the greater the acidity of the ionic liquid mixture.

Halide Containing Additive

In some embodiments, the ionic liquid reactor additionally comprises a halide containing additive. The halide containing additive can be selected, and present at a level, to provide increased yield of the middle distillate. In this embodiment, the reacting is performed with a halide containing additive in addition to the ionic liquid catalyst. The halide containing additive can boost the overall acidity and change the selectivity of the ionic liquid-based catalyst. Examples of halide containing additives are hydrogen halide, metal halide, and combinations thereof. In one embodiment, the halide containing additive may be a Bronsted acid. Examples of Bronsted acids are hydrochloric acid (HCl), hydrobromic acid (HBr), and trifluoromethanesulfonic acid. The use of halide containing additives with ionic liquid catalysts is disclosed in U.S. Published Patent Application Nos. 2003/0060359 and 2004/0077914. In one embodiment the halide containing additive is a fluorinated alkane sulphonic acid having the general formula:

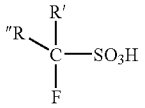

wherein R'=Cl, Br, I, H, an alkyl or perfluoro alkyl group, and R"=H, alkyl, aryl or a perfluoro alkoxy group.

Examples of metal halides that may be used are NaCl, LiCl, KCl, BeCl2, CaCl2, BaCl2, SrCl2, MgCl2, PbCl2, CuCl, ZrCl4 and AgCl, as described by Roebuck and Evering (Ind. Eng. Chem. Prod. Res. Develop., Vol. 9, 77, 1970). In one embodiment, the halide containing additive contains one or more IVB metal compounds, such as ZrCl4, ZrBr4, TiCl4, TiCl3, TiBr4, TiBr3, HfCl4, or HfBr4, as described by Hirschauer et al. in U.S. Pat. No. 6,028,024.

In one embodiment, the halide containing additive is present during the reacting step at a level that provides increased yield of the middle distillate. Adjusting the level of the halide containing additive level can change the selectivity of the alkylation reaction. For example, when the level of the halide containing additive, e.g., hydrochloric acid, is adjusted lower, the selectivity of the alkylation reaction shifts towards producing heavier products. In one embodiment, the adjustment in the level of the halide containing additive to produce heavier products does not impair the concurrent production of low volatility gasoline blending component.

In one embodiment the halide containing additive is unsupported. In another embodiment the ionic liquid catalyst and the halide containing additive are unsupported.

Alkylation Reactor

The alkylation conditions in the reactor are selected to provide the desired product yields and quality. The alkylation reaction is generally carried out in a liquid hydrocarbon phase, in a batch reactor, a semi-batch reactor, a loop reactor, or a continuous reactor. One example of a loop reactor is one where a stream comprised primarily of isoparaffin is recirculated to the ionic liquid alkylation reactor. Catalyst volume in the alkylation reactor is in the range of 1 vol % to 80 vol %, for example from 2 vol % to 70 vol %, from 3 vol % to 50 vol %, or from 5 vol % to 25 vol %. In some embodiments, vigorous mixing can be used to provide good contact between the reactants and the catalyst. In some embodiments, the isoparaffin feed, the hydrocarbon stream, and/or the ionic liquid catalyst are supplied to the ionic liquid alkylation reactor by passing them through at least one nozzle. The alkylation reaction temperature can be in the range from −40° C. to 150° C., such as −20° C. to 100° C., or −15° C. to 50° C. The pressure can be in the range from atmospheric pressure to 8000 kPa. In one embodiment the pressure is kept sufficient to keep the reactants in the liquid phase. The residence time of reactants in the reactor can be in the range of a second to 360 hours. Examples of residence times that can be used include 0.5 min to 120 min, 0.5 min to 15 min, 1 min to 120 min, 1 min to 60 min, and 2 min to 30 min.

The molar ratio of isoparaffin to olefin during the alkylation can vary over a broad range. Generally the molar ratio is in the range of from 0.5:1 to 100:1. For example, in different embodiments the molar ratio of isoparaffin to olefin is from 1:1 to 50:1, 1.1:1 to 10:1, or 1.1:1 to 20:1. Lower isoparaffin to olefin molar ratios will tend to produce a higher yield of middle distillate products.

The yield of middle distillate can be varied by adjusting the process conditions. Higher yields can be produced, for example, with lower amounts of the halide containing additive or with a lower isoparaffin to olefin molar ratio. In some embodiments, higher yields of middle distillate can be produced, for example, by using gentle agitation rather than vigorous mixing. In other embodiments, higher yields of middle distillates can be produced by using a shorter residence time of the reactants in the reactor, such as 0.5 min to 15 min. In some embodiments the yield of the middle distillate is at least equal, on a weight basis, to the amount of the C5+ olefin reacted in the ionic liquid alkylation reactor. For example, it can be at least 1.3 times, at least 1.5 times, at least 1.6 times, or at least 1.7 times the amount of the olefin reacted on a weight basis.

The refinery process can be an integrated process, where the hydrocracker, the FC cracker, and ionic liquid alkylation reactor are co-located in the same physical plant with piping between them. Alternatively, the hydrocracker, FC cracker, and ionic liquid alkylation reactor can be located distant from each other. For example, a naphtha with a low RON or high volatility from a hydrocracker, or a hydrocarbon stream from a FC cracker with C5+ olefins, might be shipped to a separate physical plant for further alkylation into high value middle distillate.

For the purposes of this specification and appended claims, unless otherwise indicated, all numbers expressing quantities, percentages or proportions, and other numerical values used in the specification and claims, are to be understood as being modified in all instances by the term "about." Furthermore, all ranges disclosed herein are inclusive of the endpoints and are independently combinable. Whenever a numerical range with a lower limit and an upper limit are disclosed, any number falling within the range is also specifically disclosed.

Any term, abbreviation or shorthand not defined is understood to have the ordinary meaning used by a person skilled in the art at the time the application is filed. The singular forms "a," "an," and "the," include plural references unless expressly and unequivocally limited to one instance.

All of the publications, patents and patent applications cited in this application are herein incorporated by reference in their entirety to the same extent as if the disclosure of each individual publication, patent application or patent was specifically and individually indicated to be incorporated by reference in its entirety.

This written description uses examples to disclose the invention, including the best mode, and also to enable any person skilled in the art to make and use the invention. Many modifications of the exemplary embodiments of the invention disclosed above will readily occur to those skilled in the art.

Accordingly, the invention is to be construed as including all structure and methods that fall within the scope of the appended claims.

EXAMPLES

Example 1

A sample of light naphtha was obtained from the Chevron Richmond refinery hydroprocessing unit using high pressure, high temperature catalytic cracking towers and distillation columns. The light naphtha sample contained 27 wt % C5, 28 wt % C6, 34 wt % C7, and 10 wt % C8+. The light naphtha sample was predominantly alkanes, with a total of about 14 wt % naphthenes and virtually no olefins.

A sample of FCC pentene was obtained from the Chevron Richmond FC cracker. The sample of FCC pentene was withdrawn after a hydrogenation unit to avoid diene contamination. The sample of FC cracker pentene contained 44 wt % olefin, of which 20 wt % were isopentenes, 16 wt % 2-pentenes, 1 wt % 1-pentene, and the remainder of the olefins being butenes. The diene content was below 200 ppm.

Alkylate was prepared in a 50 ml glass flask with magnetic stirring at room temperature (20° C.). 25 ml of a mixture of 7 wt % FCC pentene and 93 w % light naphtha was added to 5 ml N-butylpyridinium chloroaluminate ($C_5H_5NC_4H_9Al_2Cl_7$) ionic liquid to which 0.1 ml t-BuCl had been added as a chloride source. The ionic liquid and the t-BuCl were unsupported. GC samples of the hydrocarbon phase were withdrawn after 2 minutes and after 7 minutes. Olefin conversion was 97% after 2 minutes, and quantitative after 7 minutes. After 2 minutes, the remaining olefin was almost exclusively 2-pentene. The weight yield of alkylate products in the boiling range of 150° C.+ was about 1.7 times the weight amount of olefin reacted on a weight basis.

Example 2

Alkylate was prepared in a 50 ml glass flask with magnetic stirring at 0° C. A mixture of pure 2-pentene and the light naphtha was added to N-butylpyridinium chloroaluminate ($C_5H_5NC_4H_9Al_2Cl_7$) ionic liquid to which 0.1 ml t-BuCl had been added as a chloride source. The ionic liquid and the t-BuCl were unsupported. GC samples of the hydrocarbon phase were withdrawn after 2 minutes and after 10 minutes. Olefin conversion was 93% after 2 minutes, and quantitative after 10 minutes. The yield of products in the boiling range of 150° C.+ was less than 1.5 times the amount of olefin reacted on a weight basis.

Example 3

A series of alkylations in the same reactor described for Examples 1 and 2, using the same ionic liquid catalyst and chloride source, were completed. This series of alkylations used different pure methyl alkanes (methyl pentane, methyl hexane, and methyl heptane) mixed with 2-pentene as the feed. In every alkylation the quantitative olefin conversion was achieved within 10 minutes and the alkylate products contained middle distillates. The yields of products in the boiling range of 150° C.+ were 1.4 or less times the amount of olefins reacted on a weight basis.

What is claimed is:

1. An alkylation process, comprising:

a. providing an isoparaffin feed that comprises at least 50 wt % C5+;

b. providing a hydrocarbon stream that comprises at least 20 wt % C5+ olefins; and c. contacting the isoparaffin feed and the hydrocarbon stream with an acidic haloaluminate ionic liquid catalyst in an alkylation zone under alkylation conditions wherein a middle distillate is produced;

d. adjusting over time a level of a halide containing additive provided to the alkylation zone to improve a selectivity of the acidic haloaluminate ionic liquid catalyst; wherein the middle distillate has less than 10 ppm sulfur and less than 3 wt % olefin, prior to any optional hydrofinishing; and wherein the acidic haloaluminate ionic liquid catalyst has the general formula RR' R" N H+ $Al_2Cl_7$—, and wherein RR' and R" are alkyl groups containing 1 to 12 carbons, and where RR' and R" may or may not be the same.

2. The process of claim 1, wherein the alkylation zone comprises an alkylation reactor selected from the group consisting of batch reactor, semi-batch reactor, loop reactor, and continuous reactor.

3. The process of claim 1, wherein the isoparaffin feed comprises at least 28 wt % C6+.

4. The process of claim 1, wherein the isoparaffin feed comprises at least 80 wt % C5+.

5. The process of claim 1, wherein the hydrocarbon stream comprises at least 40 wt % C5+ olefins.

6. The process of claim 5, wherein the hydrocarbon stream comprises at least 80 wt % C5+ olefins.

7. The process of claim 1, wherein the isoparaffin feed comprises a naphtha from a hydrocracking operation or a Fischer-Tropsch process.

8. The process of claim 1, wherein the hydrocarbon stream comprises FC cracker pentene.

9. The process of claim 1, wherein the hydrocarbon stream has greater than 100 ppm sulfur.

10. An alkylation process, comprising:

a. contacting a naphtha comprising C5+ isoparaffins and having a RON less than 70, and a hydrocarbon stream comprising C5 olefins with an acidic haloaluminate ionic liquid catalyst in an alkylation reactor under alkylation conditions to produce an alkylate product, wherein the acidic haloaluminate ionic liquid catalyst has the general formula RR' R" N H+ $Al_2Cl_7$—, and wherein RR' and R" are alkyl groups containing 1 to 12 carbons, and where RR' and R" may or may not be the same;

b. adjusting over time a level of a halide containing additive provided to the ionic liquid alkylation reactor to improve a selectivity of the acidic haloaluminate ionic liquid catalyst; and c. recovering a middle distillate from the alkylate product, wherein the middle distillate comprises less than 3 wt % olefin prior to any optional hydrofinishing.

11. The process of claim 10, wherein the RON is less than 60.

12. The process of claim 11, wherein the RON is less than 50.

13. The process of claim 10, wherein the naphtha is from a hydrocracking operation or a Fischer-Tropsch process.

14. The process of claim 10, wherein the hydrocarbon stream comprising C5 olefins is from a FC cracker.

15. The process of claim 10, wherein the naphtha comprises at least 50 wt % C5+ isoparaffins.

16. The process of claim 1 or claim 10, wherein the middle distillate comprises less than 1 wt % olefin.

17. The process of claim 2, or claim 10, wherein the reactor comprises an acidic haloaluminate ionic liquid catalyst.

18. The process of claim 2, or claim 10, wherein the reactor comprises an unsupported ionic liquid catalyst and an unsupported halide containing additive.

19. The process of claim 1, or claim 10, wherein the yield of the middle distillate is at least 1.5 times, on a weight basis, the amount of olefin reacted in the ionic liquid alkylation reactor.

20. The process of claim 19, wherein the yield is at least 1.6 times.

21. The process of claim 1, or claim 10, wherein the middle distillate has less than 5 ppm sulfur.

22. The process of claim 1, or claim 10, wherein the middle distillate has less than 0.5 wt % olefin.

23. The process of claim 7, or claim 10, wherein the naphtha has a RVP greater than 20.7 kPa.

24. The process of claim 1, or claim 10, wherein the hydrocarbon stream has a RVP greater than 20.7 kPa.

25. The process of claim 1, or claim 10, wherein the middle distillate has a boiling range of 150° C.+.

26. The process of claim 1, or claim 10, wherein the alkylation conditions include gentle agitation.

27. The process of claim 2, or claim 10, wherein the residence time of reactants in the reactor is in the range of 0.5 minutes to 15 minutes.

28. An alkylation process, comprising:

a. providing an isoparaffin feed that comprises at least 50 wt % C5+;

b. providing a hydrocarbon stream that comprises at least 20 wt % C5+ olefins;

c. contacting the isoparaffin feed and the hydrocarbon stream with an acidic haloaluminate ionic liquid catalyst in an alkylation zone under alkylation conditions wherein a middle distillate is produced;

d. adjusting over time a level of a halide containing additive provided to the alkylation zone to improve a selectivity of the acidic haloaluminate ionic liquid catalyst; wherein the middle distillate has less than 10 ppm sulfur and less than 3 wt % olefin, prior to any optional hydrofinishing; and wherein the acidic haloaluminate ionic liquid catalyst is an alkyl substituted pyridinium chloroaluminate or an alkyl substituted imidazolium chloroaluminate of the general formula A and B, respectively,

A

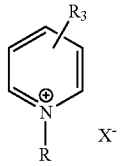

-continued

B

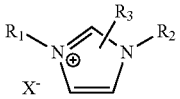

where R, $R_1$, $R_2$, and $R_3$=H, methyl, ethyl, propyl, butyl, pentyl or hexyl group, and X is a chloroaluminate, and where R, $R_1$, $R_2$ and $R_3$ may or may not be the same.

29. An alkylation process, comprising:

a. contacting a naphtha comprising C5+ isoparaffins and having a RON less than 70, and a hydrocarbon stream comprising C5 olefins with an acidic haloaluminate ionic liquid catalyst in an alkylation reactor under alkylation conditions to produce an alkylate product, wherein the acidic haloaluminate ionic liquid catalyst is an alkyl substituted pyridinium chloroaluminate or an alkyl substituted imidazolium chloroaluminate of the general formula A and B, respectively,

A

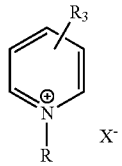

B

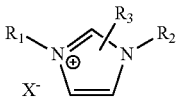

where R, $R_1$, $R_2$, and $R_3$=H, methyl, ethyl, propyl, butyl, pentyl or hexyl group, and X is a chloroaluminate, and where R, $R_1$, $R_2$ and $R_3$ may or may not be the same;

b. adjusting over time a level of a halide containing additive provided to the ionic liquid alkylation reactor to improve a selectivity of the acidic haloaluminate ionic liquid catalyst; and c. recovering a middle distillate from the alkylate product, wherein the middle distillate comprises less than 3 wt % olefin prior to any optional hydrofinishing.

* * * * *